US008852011B2

(12) United States Patent
Galinski

(10) Patent No.: US 8,852,011 B2
(45) Date of Patent: Oct. 7, 2014

(54) INFLATABLE PLAY STRUCTURE AND SYSTEM

(75) Inventor: Andrea Galinski, Racine, WI (US)

(73) Assignee: OSA Brands, LLC, Monroe, WI (US)

( * ) Notice: Subject to any disclaimer, the term of this patent is extended or adjusted under 35 U.S.C. 154(b) by 84 days.

(21) Appl. No.: 13/250,814

(22) Filed: Sep. 30, 2011

(65) Prior Publication Data

US 2013/0085005 A1 Apr. 4, 2013

(51) Int. Cl.

| | |
|---|---|
| ***A63G 31/00*** | (2006.01) |
| ***A63H 33/00*** | (2006.01) |
| ***A63G 31/12*** | (2006.01) |

(52) U.S. Cl.

CPC ..... *A63G 31/12* (2013.01); *A63H 33/008* (2013.01)

USPC ..... 472/134

(58) Field of Classification Search

USPC ..... 472/134

See application file for complete search history.

(56) References Cited

U.S. PATENT DOCUMENTS

| | | | | |
|---|---|---|---|---|
| 4,099,773 | A * | 7/1978 | Chang | 297/270.5 |
| 4,267,662 | A | 5/1981 | Gordy | |
| 4,459,714 | A * | 7/1984 | Lin | 5/655.3 |
| 4,884,988 | A | 12/1989 | McMurray | |
| 5,273,477 | A | 12/1993 | Adams, Jr. | |
| 5,678,357 | A | 10/1997 | Rubio et al. | |
| 6,565,405 | B2 | 5/2003 | Hsu et al. | |
| 6,810,896 | B2 | 11/2004 | Ueda et al. | |
| 7,104,864 | B1 | 9/2006 | Liou | |
| 2008/0242188 | A1 | 10/2008 | Yanagita | |

* cited by examiner

*Primary Examiner* — Michael Dennis
(74) *Attorney, Agent, or Firm* — Ladas & Parry LLP

(57) ABSTRACT

An inflatable play structure and system, the inflatable play structure including an inflatable envelope; and a weighted base attached to the inflatable envelope, the weighted base having a first base portion and a second base portion, the first base portion being attached to the second base portion by a base hinge. The first base portion and the second base portion are operable to enfold the inflatable envelope when the inflatable envelope is deflated and the first base portion and the second base portion are folded along the base hinge toward the inflatable envelope.

11 Claims, 10 Drawing Sheets

INFLATABLE PLAY STRUCTURE AND SYSTEM

TECHNICAL FIELD

The technical field of this disclosure is play structures for children, particularly, inflatable play structures and systems.

BACKGROUND OF THE INVENTION

Play structures, such as tents, playhouses, and tunnels, provide children with the opportunity for creative play and development. Children can use their imaginations in fantasy and role-playing situations. In some cases, the play structure is assembled from a number of interlocking rooms or parts. The children can develop motor skills and spatial awareness by assembling the parts in different combinations, then interacting with the assemblage.

Such play structures typically include a frame with a wall or fabric supported by the frame. In some cases, an inflatable frame is integral to the wall to allow the play structure to be deflated and stored in a small bag. This allows the play structure to be stored out of the way when not in use. Play structures are usually made of lightweight materials to allow easy shipping and storage.

Unfortunately, problems exist with presently available play structures and play structure systems. Present devices are made of lightweight materials for shipping and storage, but are too light to stay in place when being used by children. The component parts slide across the floor and turn upside down. Another problem is protection of the play structure during shipping and storage. A rigid structure for the frame and walls avoids damage, but is cumbersome and increases shipping costs. An inflatable structure takes up less space, but is not protected from damage by surrounding objects. For example, a customer deflating a play structure, placing it in a bag for storage, and placing the bag in a closet often returns to find the play structure damaged and no longer inflatable, because something else stored in the closet has poked a hole in the play structure.

It would be desirable to have an inflatable play structure and system that overcomes the above disadvantages.

SUMMARY OF THE INVENTION

One aspect of the invention provides an inflatable play structure including an inflatable envelope; and a weighted base attached to the inflatable envelope, the weighted base having a first base portion and a second base portion, the first base portion being attached to the second base portion by a base hinge. The first base portion and the second base portion are operable to enfold the inflatable envelope when the inflatable envelope is deflated and the first base portion and the second base portion are folded along the base hinge toward the inflatable envelope.

Another aspect of the invention provides an inflatable play structure system including an inflatable play structure and a connector. The inflatable play structure includes an inflatable envelope; a weighted base attached to the inflatable envelope, the weighted base having a first base portion and a second base portion, the first base portion being attached to the second base portion by a base hinge, the weighted base further having a base edge; and a base fastener portion attached along the base edge. The first base portion and the second base portion are operable to enfold the inflatable envelope when the inflatable envelope is deflated and the first base portion and the second base portion are folded along the base hinge toward the inflatable envelope. The connector includes a panel having a first panel edge and a second panel edge; a first panel fastener portion attached along the first panel edge; and a second panel fastener portion attached along the second panel edge. At least one of the first panel fastener portion and the second panel fastener portion is mateable with the base fastener portion.

The foregoing and other features and advantages of the invention will become further apparent from the following detailed description of the presently preferred embodiment, read in conjunction with the accompanying drawings. The drawings are not to scale. The detailed description and drawings are merely illustrative and are not meant to limit the scope of the invention being defined by the appended claims and equivalents thereof.

BRIEF DESCRIPTION OF THE DRAWINGS

Throughout the figures, like reference numbers refer to like elements.

DETAILED DESCRIPTION

Figure 1A:
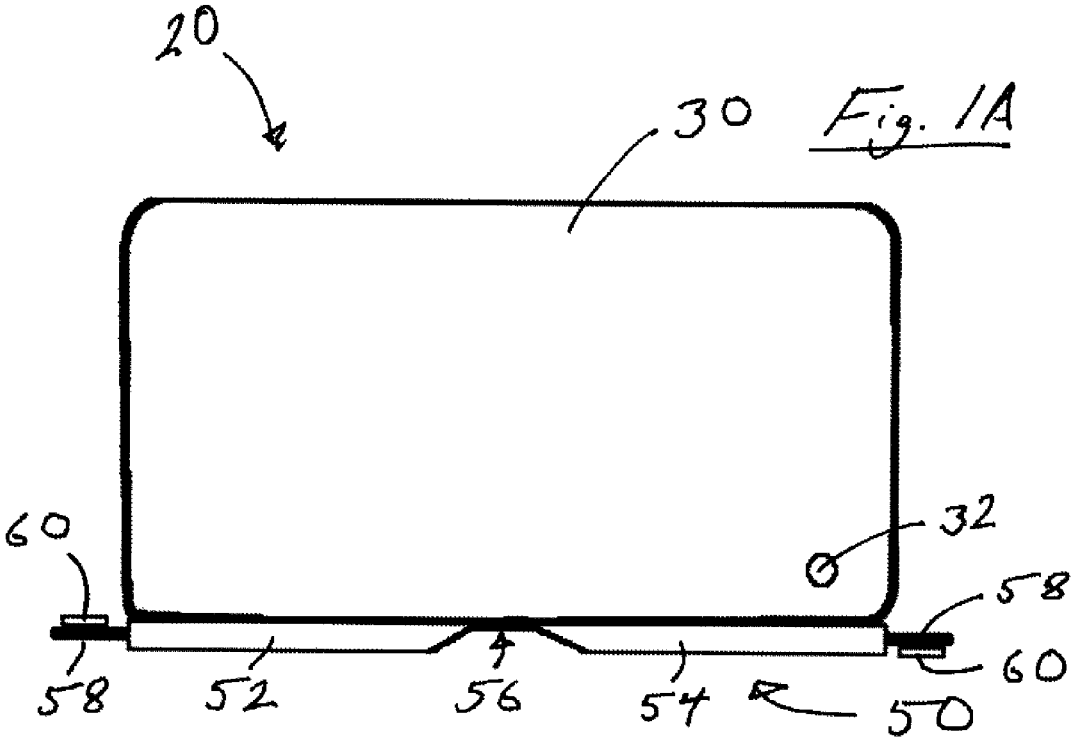
FIGS. 1A & 1B are schematic views of an inflatable play structure in accordance with the invention.
Figure 1B:
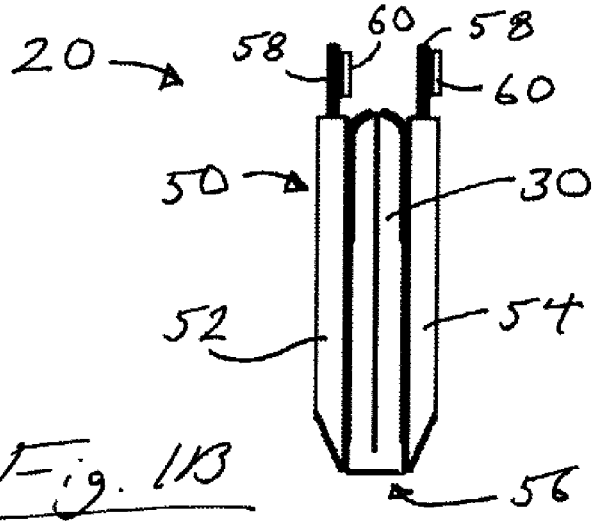

FIGS. 1A & 1B are schematic views of an inflatable play structure in accordance with the invention. FIG. 1A illustrates the inflatable play structure in an open, inflated configuration and FIG. 1B illustrates the inflatable play structure and a closed, folded configuration.

Referring to FIG. 1A, the inflatable play structure 20 includes an inflatable envelope 30 and a weighted base 50 attached to the inflatable envelope 30. The weighted base 50 has a first base portion 52 and a second base portion 54. The first base portion 52 is attached to the second base portion 54 by a base hinge 56. In one embodiment, the base hinge 56 is flexible material disposed between the first base portion 52 and the second base portion 54. In this example, the inflatable play structure 20 is in an open configuration, which is defined herein as a configuration in which the inflatable envelope 30 is inflated and the weighted base 50 is substantially planar.

The inflatable envelope 30 can define a geometric figure when the inflatable envelope 30 is inflated and the inflatable play structure 20 is in the open configuration. Exemplary geometric figures include rectangular figures, half-cylindrical figures, trapezoidal figures, and the like. In one embodiment, the inflatable envelope can also define a tunnel through the geometric figure. The inflatable envelope 30 can be inflatable before being attached to the weighted base 50, or a portion of the weighted base 50 can form a wall of the inflatable envelope 30 so that the inflatable envelope 30 cannot be inflated until attached to the weighted base 50. The inflatable envelope 30 can also include a valve 32 for inflation and deflation of the inflatable envelope 30. The inflatable envelope 30 can be made of any material which is impermeable to gases. In one embodiment, the inflatable envelope 30 can be made of thin flexible plastic sheeting, either as a single unit or as separate sheets joined together to define the shape of the inflatable envelope 30. In one example, the inflatable envelope 30 is made of flexible polyvinylchloride (PVC) sheeting. In another example, the inflatable envelope 30 is made of nylon, such as a coated nylon.

The weighted base 50 can have one or more base edges 58 and base fastener portions 60 can be attached along the base edges 58. The base fastener portion 60 can be used to attach one inflatable play structure to another inflatable play structure or to a connector. The base fastener portion 60 can be applied to the upper side or the lower side of the base edge 58 as desired for a particular application. In one example, the base fastener portion 60 is one of a hook fastener or a loop fastener, mateable with the complementary hook fastener or loop fastener on another inflatable play structure or connector to be attached. Those skilled in the art will appreciate that the base fastener portion can be any type of fastener allowing removable attachment, such as hook and loop fasteners, snaps, ties, buttons, or the like. One or more grommets can be fixed through one or more of the base edges 58 to define tie-down holes for stakes, so that the inflatable play structure 20 can be staked down in the yard during outdoor use. In one example, grommets are installed through the base edges 58 at all four corners of the weighted base 50.

Referring to FIG. 1B, the first base portion 52 and the second base portion 54 enfold the inflatable envelope 30 when the inflatable envelope 30 is deflated and the first base portion 52 and the second base portion 54 are folded along the base hinge 56 toward the inflatable envelope 30. In this example, the inflatable play structure 20 is in a closed configuration, which is defined herein as a configuration in which the inflatable envelope 30 is deflated, and the first base portion 52 is folded together with the second base portion 54 around the inflatable envelope 30 so that the first base portion 52 and the second base portion 54 are substantially parallel.

Figure 2A:
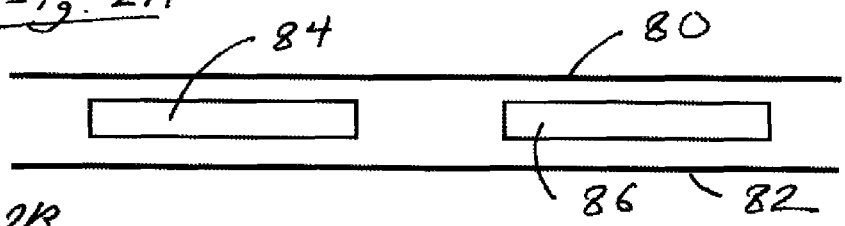
FIGS. 2A-2C are schematic views of a weighted base for an inflatable play structure in accordance with the invention.
Figure 2B:
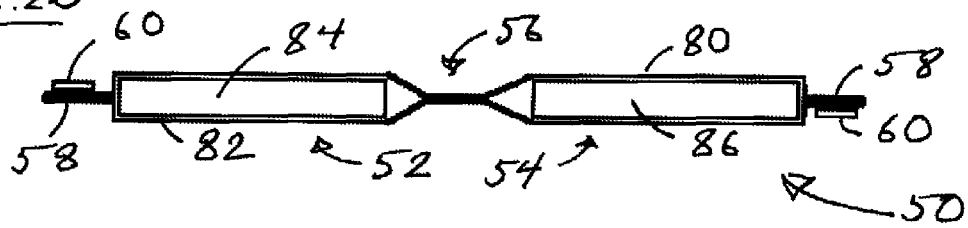
Figure 2C:
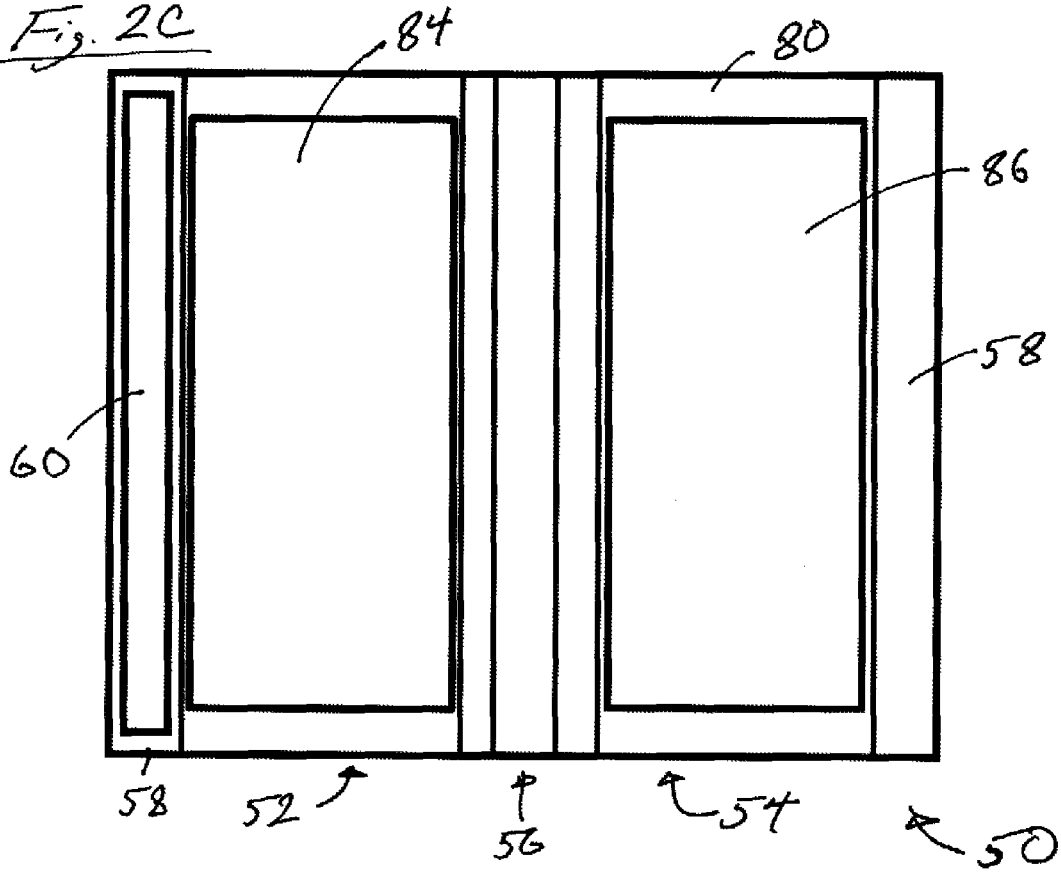

FIGS. 2A-2C are schematic views of a weighted base for an inflatable play structure in accordance with the invention. FIG. 2A is a side cross section schematic view of the components for the weighted base. FIG. 2B is a side cross section schematic view of a weighted base. FIG. 2C is a top schematic view of the weighted base.

Referring to FIG. 2A, the weighted base can be formed from a first sheet 80, a second sheet 82, a first weight piece 84, and a second weight piece 86. The first weight piece 84 and the second weight piece 86 are disposed between the first sheet 80 and the second sheet 82. The first weight piece 84 and the second weight piece 86 are spaced apart to allow for the base hinge and do not overlap.

Referring to FIGS. 2B & 2C, the weighted base 50 includes the first base portion 52 with the first weight piece 84 and the second base portion 54 with the second weight piece 86. The first sheet 80 and the second sheet 82 are attached to each other around the perimeter of the first weight piece 84 and second weight piece 86 to form the base hinge 56 and the base edges 58. The sheets 80, 82 can be attached to each other and the base fastener portions 60 attached to the base edges 58 by plastic welding, sewing, adhesive, a combination thereof, or the like. In one embodiment, one or both of the weight pieces 84, 86 can be attached to the sheets 80, 82. In another embodiment, the weight pieces 84, 86 can be unattached to the sheets 80, 82 and left free to float. In one embodiment, the sheets 80, 82 can be top and bottom portions of a cylinder into which the weight pieces 84, 86 are inserted before attaching the sheets 80, 82 together. In another embodiment, the sheets 80, 82 can be pulled close to the weight pieces 84, 86 with a vacuum so that the sheets 80, 82 conform closely to the weight pieces 84, 86. The inflatable envelope can be attached to the weighted base 50 after the weighted base 50 has been fabricated. In one embodiment, the connector can be fabricated in the same manner as the weighted base, but the inflatable envelope is omitted.

The sheets 80, 82 can be made of any sheeting which can be joined around the weight pieces 84, 86. In one embodiment, the sheets 80, 82 can be made of thin flexible plastic sheeting. In one example, the sheets 80, 82 are made of flexible polyvinylchloride (PVC) sheeting. In another example, the sheets 80, 82 are made of nylon, such as a coated nylon. Weight pieces 84, 86 can be made of any durable material of sufficient weight to weigh down and stabilize the inflatable play structure in the open configuration, and to stiffen the inflatable play structure in the closed configuration. The weight pieces 84, 86 can also be soft to cushion users from contact with the floor supporting the inflatable play structure. In one example, the weight pieces 84, 86 are made of polyethylene foam. In another example, the weight pieces 84, 86 can be made of open cell foam or closed cell foam.

Figure 3A:
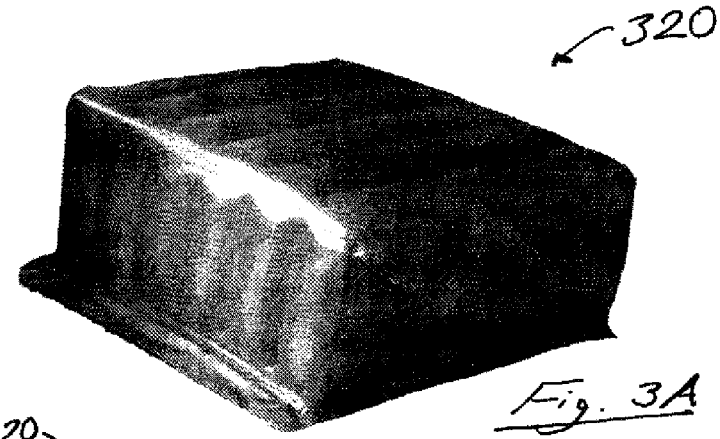
FIGS. 3A-3E are various views of an inflatable play structure defining a rectangular figure in accordance with the invention.
Figure 3B:
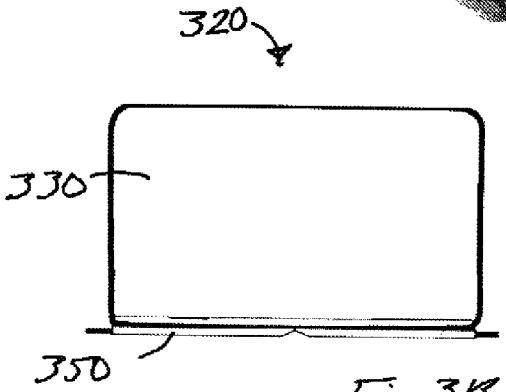
Figure 3C:
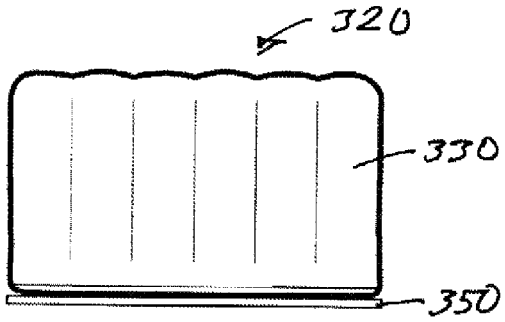
Figure 3D:
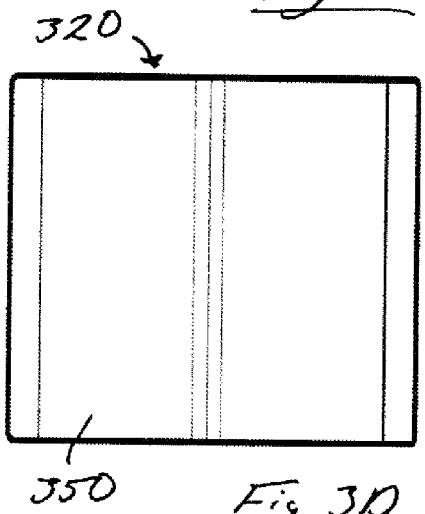
Figure 3E:
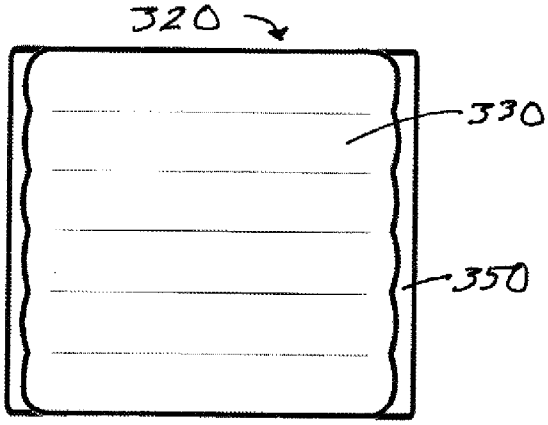

FIGS. 3A-3E are various views of an inflatable play structure defining a rectangular figure in accordance with the invention. In this embodiment, the inflatable envelope 330 of the inflatable play structure 320 is attached to a weighted base 350 and defines the geometric figure of a rectangular figure when the inflatable envelope 330 is inflated. FIG. 3A is a perspective view of the inflatable play structure; FIG. 3B is a right side view of the of the inflatable play structure, the left side view (omitted) being a minor image thereof; FIG. 3C is a front view of the inflatable play structure, the rear view (omitted) being a mirror image thereof; FIG. 3D is a bottom view of the inflatable play structure; FIG. 3E is a top view of the inflatable play structure.

Figure 4A:
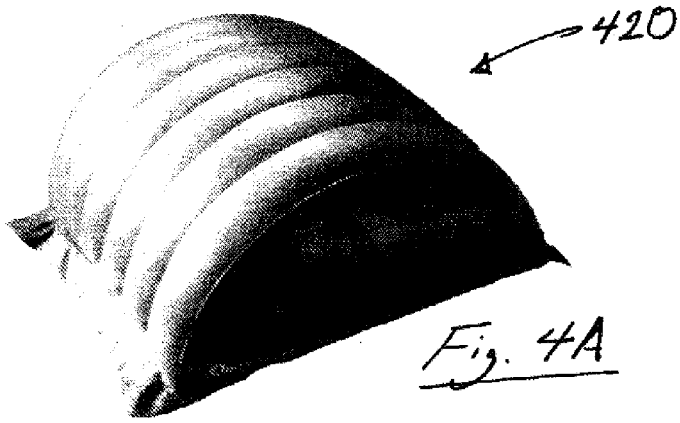
FIGS. 4A-4E are various views of an inflatable play structure defining a half-cylindrical figure in accordance with the invention.
Figure 4B:
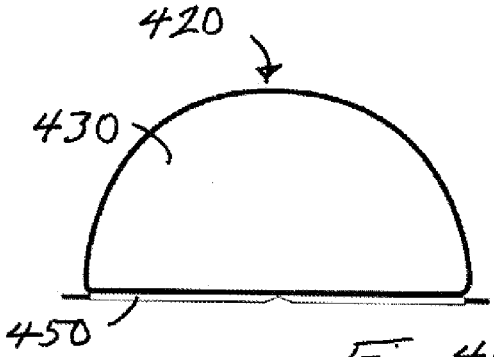
Figure 4C:
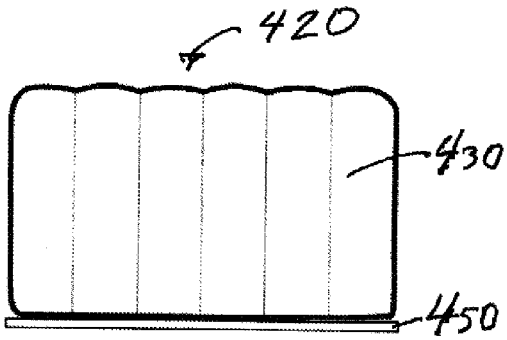
Figure 4D:
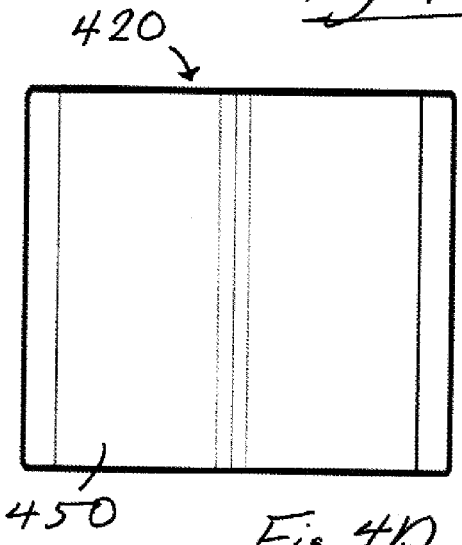
Figure 4E:
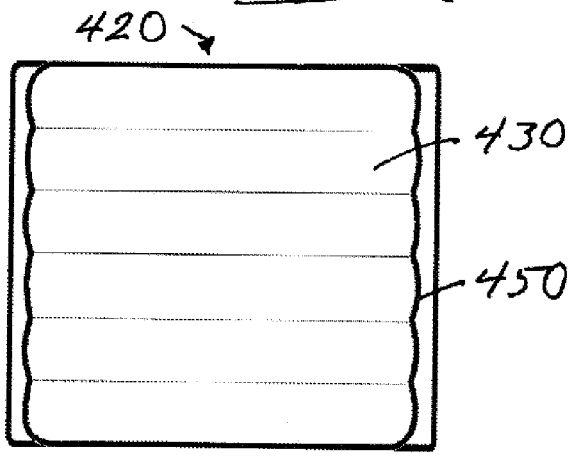

FIGS. 4A-4E are various views of an inflatable play structure defining a half-cylindrical figure in accordance with the invention. In this embodiment, the inflatable envelope 430 of the inflatable play structure 420 is attached to a weighted base 450 and defines the geometric figure of a half-cylindrical figure when the inflatable envelope 430 is inflated. FIG. 4A is a perspective view of the inflatable play structure; FIG. 4B is a right side view of the of the inflatable play structure, the left side view (omitted) being a mirror image thereof; FIG. 4C is a front view of the inflatable play structure, the rear view (omitted) being a minor image thereof; FIG. 4D is a bottom view of the inflatable play structure; FIG. 4E is a top view of the inflatable play structure.

Figure 5A:
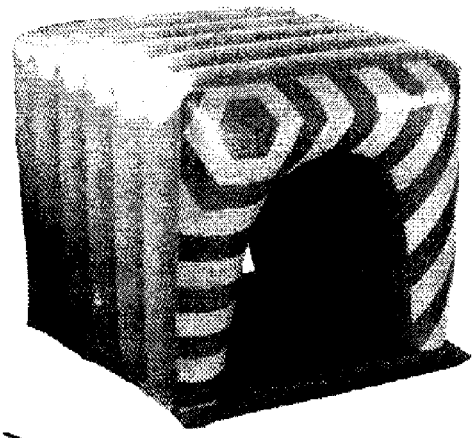
FIGS. 5A-5E are various views of an inflatable play structure defining a geometric figure with a tunnel in accordance with the invention.
Figure 5B:
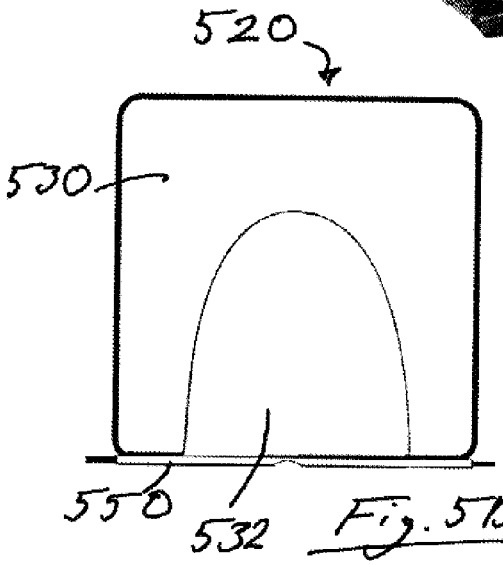
Figure 5C:
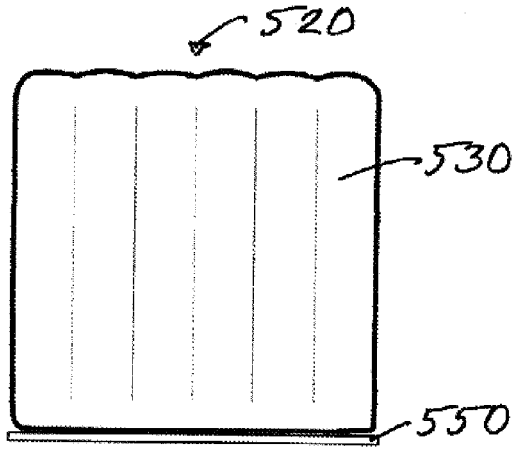
Figure 5D:
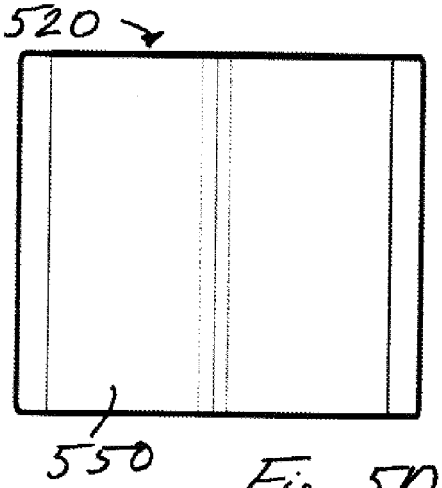
Figure 5E:
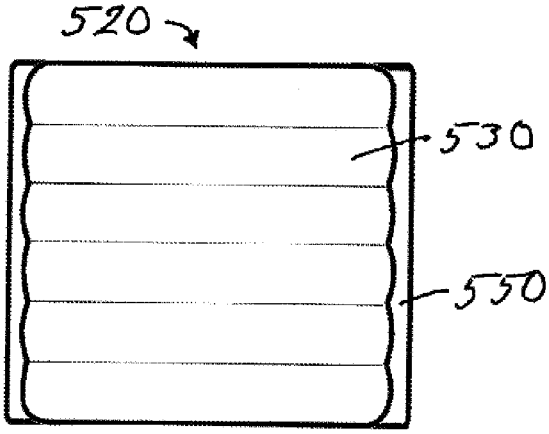

FIGS. 5A-5E are various views of an inflatable play structure defining a geometric figure with a tunnel in accordance with the invention. In this embodiment, the inflatable envelope 530 of the inflatable play structure 520 is attached to a weighted base 550 and defines the geometric figure of a rectangular figure with a tunnel 532 through the geometric figure when the inflatable envelope 530 is inflated. FIG. 5A is a perspective view of the inflatable play structure; FIG. 5B is a right side view of the of the inflatable play structure, the left side view (omitted) being a mirror image thereof; FIG. 5C is a front view of the inflatable play structure, the rear view (omitted) being a mirror image thereof; FIG. 5D is a bottom view of the inflatable play structure; FIG. 5E is a top view of the inflatable play structure.

Figure 6A:
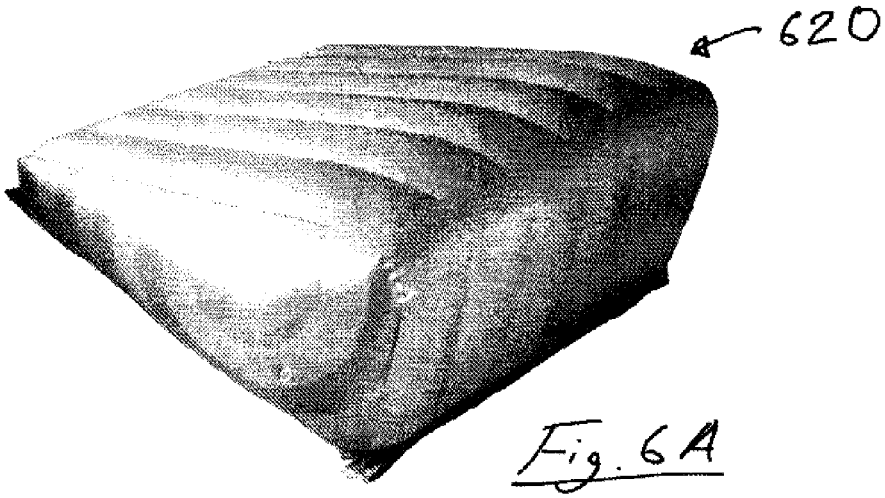
FIGS. 6A-6F are various views of an inflatable play structure defining a trapezoidal figure in accordance with the invention.
Figure 6B:
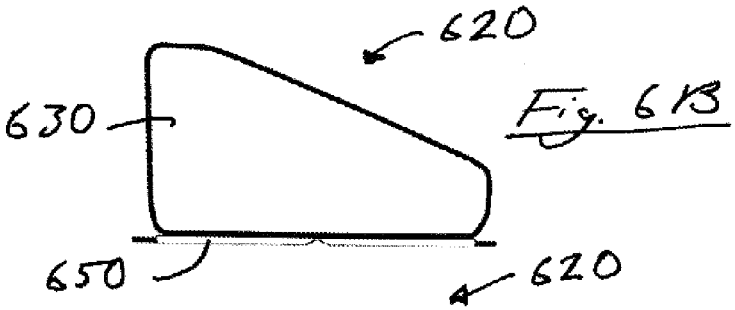
Figure 6C:
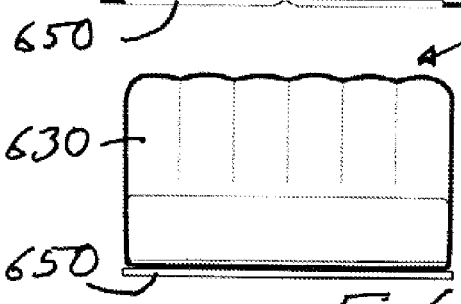
Figure 6D:
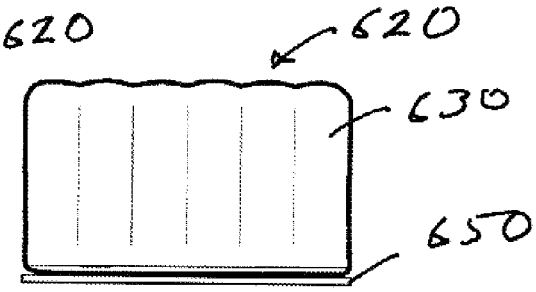
Figure 6E:
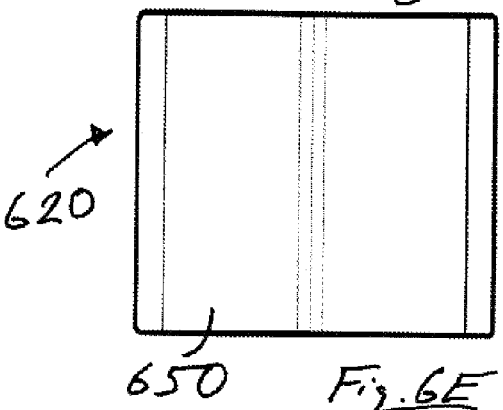
Figure 6F:
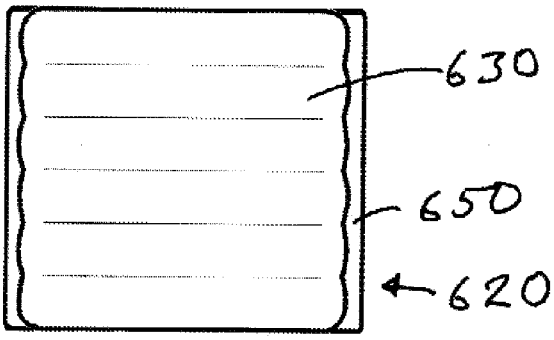

FIGS. 6A-6F are various views of an inflatable play structure defining a trapezoidal figure in accordance with the invention. In this embodiment, the inflatable envelope 630 of the inflatable play structure 620 is attached to a weighted base 650 and defines the geometric figure of a rectangular figure when the inflatable envelope 630 is inflated. FIG. 6A is a perspective view of the inflatable play structure; FIG. 6B is a left side view of the of the inflatable play structure, the right side view (omitted) being a mirror image thereof; FIG. 6C is a front view of the inflatable play structure; FIG. 6D is a rear view of the inflatable play structure; FIG. 6E is a bottom view of the inflatable play structure; FIG. 6F is a top view of the inflatable play structure.

Figure 7A:
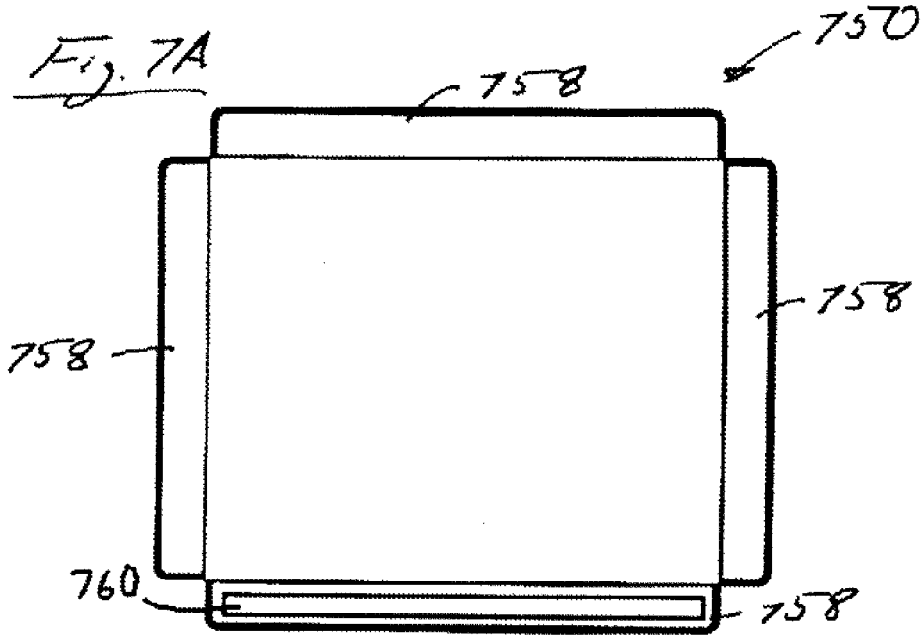
FIGS. 7A-7C are various views of a broad connector for an inflatable play structure system in accordance with the invention.
Figure 7B:
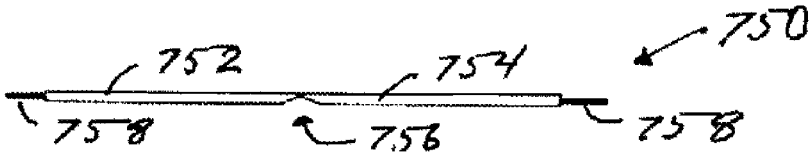
Figure 7C:
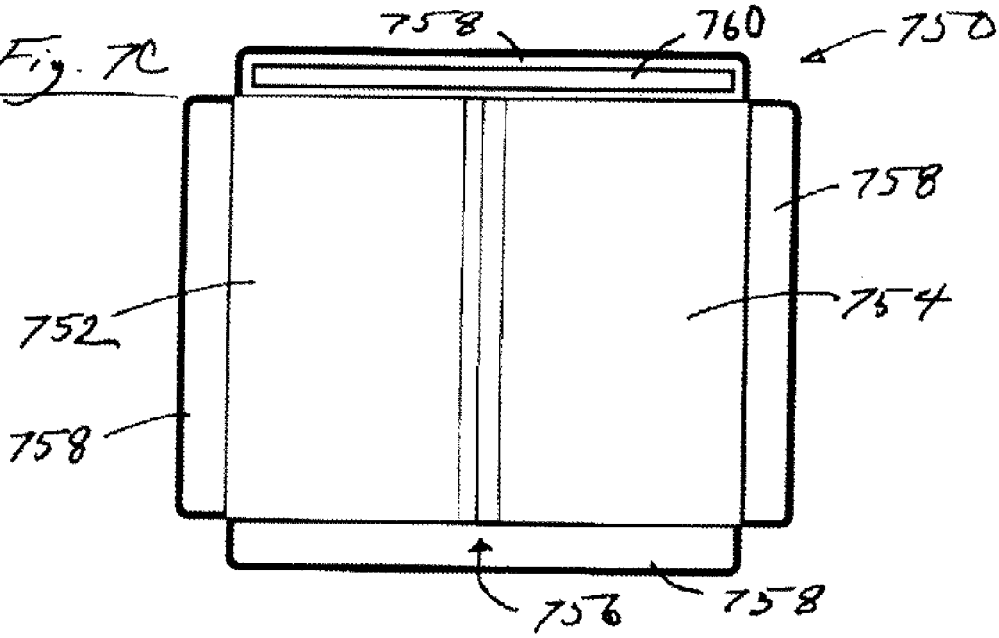

FIGS. 7A-7C are various views of a broad connector for an inflatable play structure system in accordance with the invention. FIG. 7A is a top view of the broad connector; FIG. 7B is a side view of the broad connector; FIG. 7C is a bottom view of the broad connector. The length and/or width of the broad connector can be selected to match the dimensions of the inflatable play structures or connectors. In this example, four panel edges are sized to match the width of the inflatable play structures.

The broad connector 750 is a panel that has a first panel portion 752 and a second panel portion 754. In one embodiment, the first panel portion 752 is attached to the second panel portion 754 by a panel hinge 756. The panel hinge 756 can be a flexible material disposed between the first panel portion 752 and the second panel portion 754. The broad connector 750 can have one or more panel edges 758 and panel fastener portions 760 can be attached along the panel edges 758. The panel fastener portion 760 can be used to attach the connector to an inflatable play structure to or to another connector. In this example, one panel fastener portion 760 is attached to the upper side of one panel edge 758 and another panel fastener portion 760 is attached to the lower side of the opposite panel edge 758. The panel fastener portion 760 can be applied to the upper side or the lower side of the panel edge 758 as desired for a particular application. In one example, the panel fastener portion 760 is one of a hook fastener or a loop fastener, mateable with the complementary hook fastener or loop fastener on another inflatable play structure or connector to be attached. Those skilled in the art will appreciate that the base fastener portion can be any type of fastener allowing removable attachment, such as hook and loop fasteners, snaps, ties, buttons, or the like. One or more grommets can be fixed through one or more of the panel edges 758 to define tie-down holes for stakes, so that the broad connector 750 can be staked down in the yard during outdoor use. In one example, grommets are installed through the panel edges 758 at all four corners of the broad connector 750.

Figure 8A:
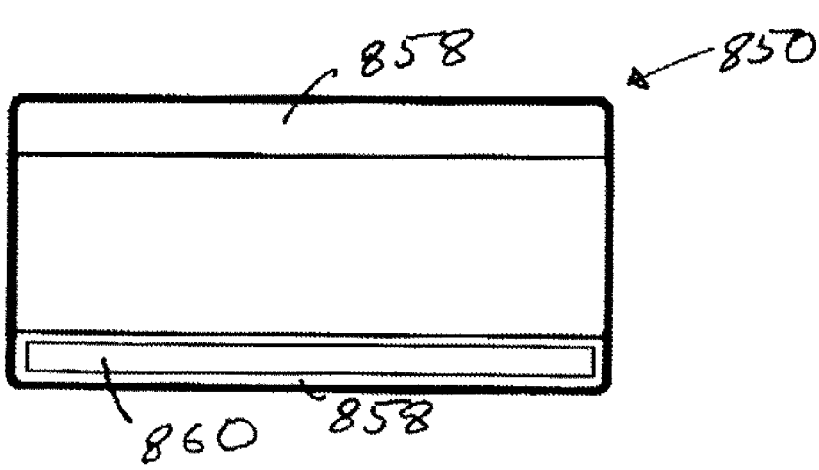
FIGS. 8A-8C are various views of a narrow connector for an inflatable play structure system in accordance with the invention.
Figure 8B:
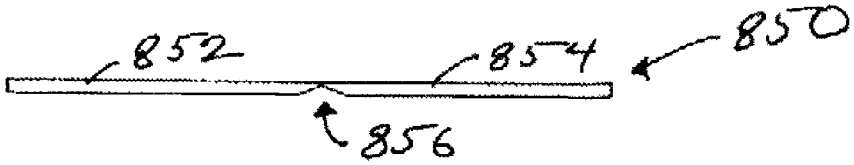
Figure 8C:
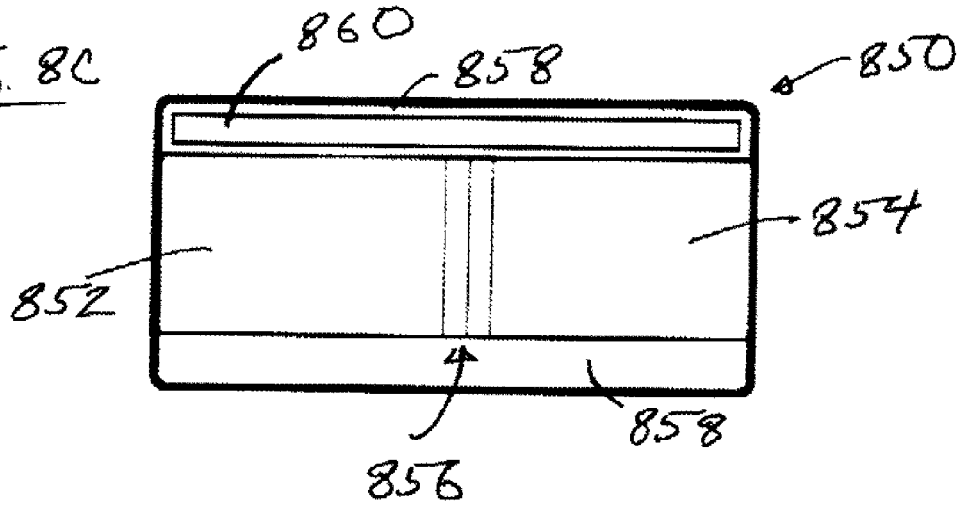

FIGS. 8A-8C are various views of a narrow connector for an inflatable play structure system in accordance with the invention. FIG. 8A is a top view of the narrow connector; FIG. 8B is a side view of the narrow connector; FIG. 8C is a bottom view of the narrow connector. The length and/or width of the broad connector can be selected to match the dimensions of the inflatable play structures or connectors. In this example, the length of two panel edges are selected to match the width of the inflatable play structures.

The narrow connector 850 is a panel that has a first panel portion 852 and a second panel portion 854. In one embodiment, the first panel portion 852 is attached to the second panel portion 854 by a panel hinge 856. The panel hinge 856 can be a flexible material disposed between the first panel portion 852 and the second panel portion 854. The broad connector 850 can have one or more panel edges 858 and panel fastener portions 860 can be attached along the panel edges 858. The panel fastener portion 860 can be used to attach the connector to an inflatable play structure to or to another connector. In this example, one panel fastener portion 860 is attached to the upper side of one panel edge 858 and another panel fastener portion 860 is attached to the lower side of the opposite panel edge 858. The panel fastener portion 860 can be applied to the upper side or the lower side of the panel edge 858 as desired for a particular application. In one example, the panel fastener portion 860 is one of a hook fastener or a loop fastener, mateable with the complementary hook fastener or loop fastener On another inflatable play structure or connector to be attached. Those skilled in the art will appreciate that the base fastener portion can be any type of fastener allowing removable attachment, such as hook and loop fasteners, snaps, ties, buttons, or the like. One or more grommets can be fixed through one or more of the panel edges 858 to define tie-down holes for stakes, so that the narrow connector 850 can be staked down in the yard during outdoor use. In one example, grommets are installed through the panel edges 858 at all four corners of the narrow connector 850.

Figure 9:
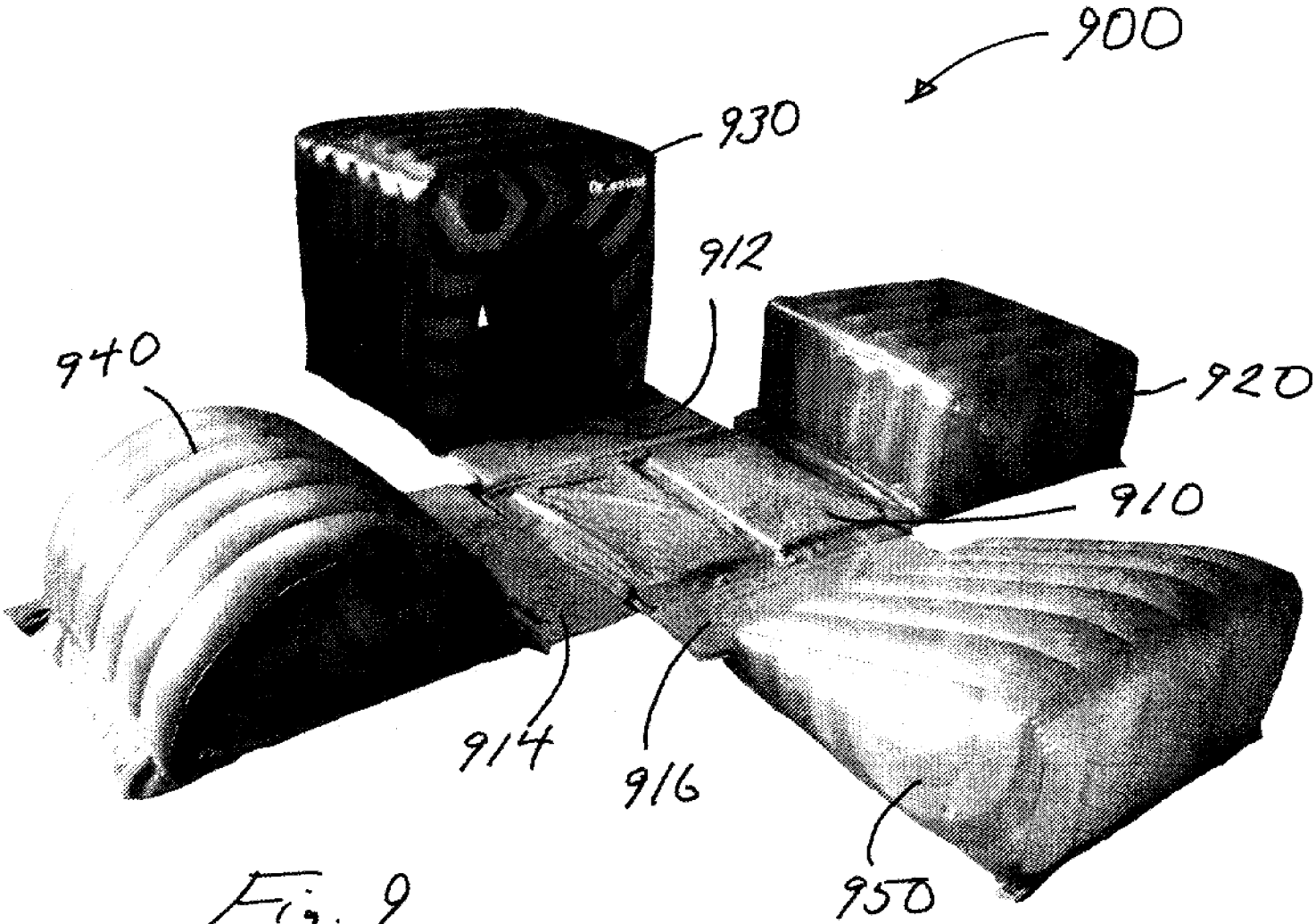
FIG. 9 is a perspective view of an inflatable play structure system in accordance with the invention.

FIG. 9 is a perspective view of an inflatable play structure system in accordance with the invention. The various inflatable play structures and connectors are attached to each other with fastener portions along their edges. In this example, the inflatable play structure system 900 includes a broad connector 910, with narrow connectors 912, 914, 916 attached to the broad connector 910. The broad connector 910 is also attached to inflatable play structure 920, in which the inflatable envelope defines a rectangular figure. The narrow connector 912 is also attached to inflatable play structure 930, in which the inflatable envelope defines a rectangular figure with a tunnel. The narrow connector 914 is also attached to the inflatable play structure 940, in which the inflatable envelope defines a half-cylindrical figure. The narrow connector 916 is also attached to inflatable play structure 950, in which the inflatable envelope defines a trapezoidal figure. Those skilled in the art will appreciate that the connectors and inflatable play structures can be arranged in a number of combinations to achieve the desired play environment. The inflatable play structures can be used individually and independently, with each other, and/or with or without connectors.

Figure 10:
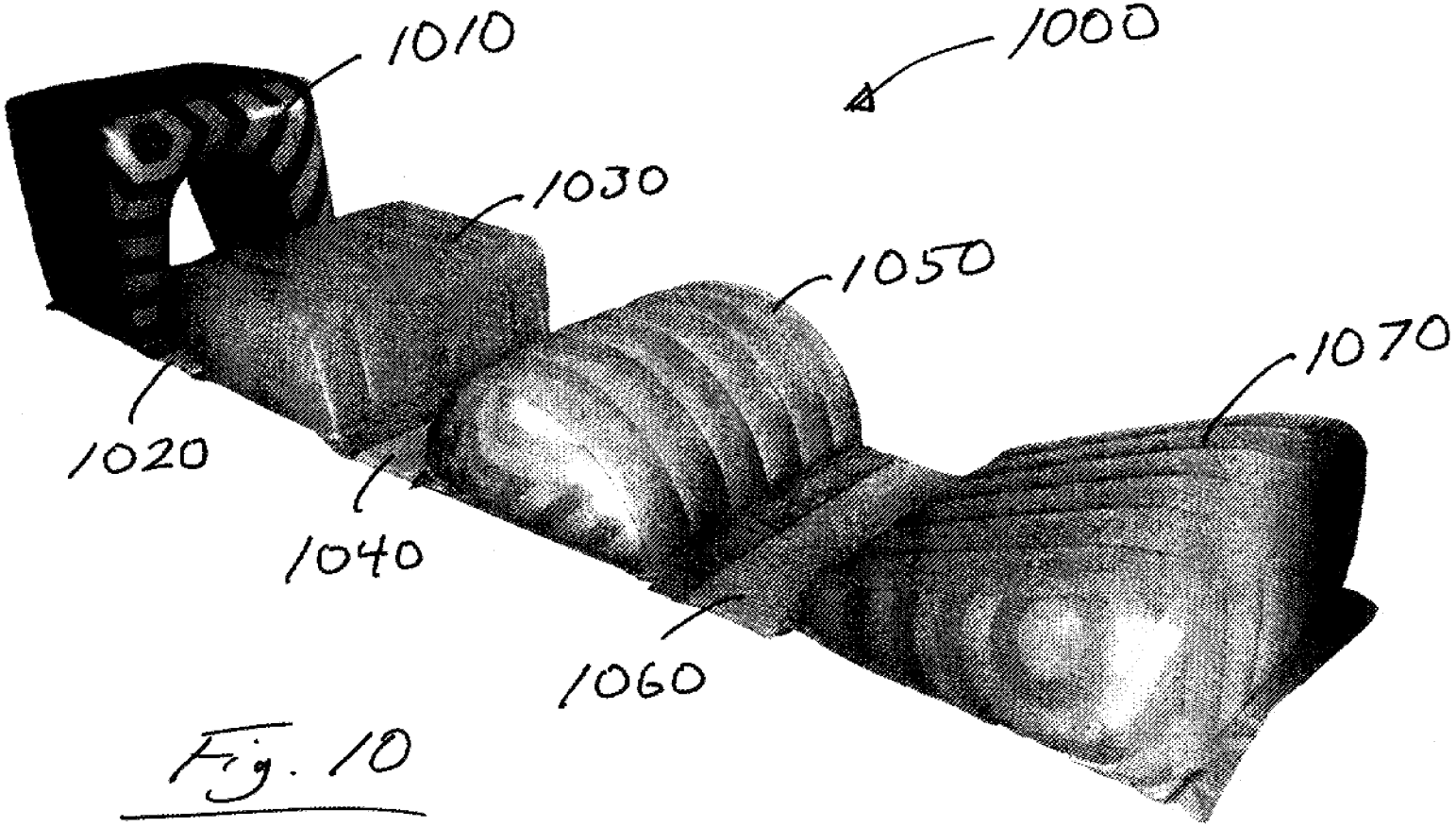
FIG. 10 is another perspective view of an inflatable play structure system in accordance with the invention.

FIG. 10 is another perspective view of an inflatable play structure system in accordance with the invention. The various inflatable play structures and connectors are attached to each other with fastener portions along their edges. In this example, the inflatable play structure system 1000 includes inflatable play structure 1010, in which the inflatable envelope defines a rectangular figure with a tunnel, attached to narrow connector 1020. Narrow connector 1020 is also attached to inflatable play structure 1030, in which the inflatable envelope defines a rectangular figure, which is attached to narrow connector 1040. Narrow connector 1040 is also connected to inflatable play structure 1050, in which the inflatable envelope defines a half-cylindrical figure, which is attached to narrow connector 1060. Finally, narrow connector 1060 is also connected to inflatable play structure 1070, in which the inflatable envelope defines a trapezoidal figure. Those skilled in the art will appreciate that the connectors and inflatable play structures can be arranged in a number of combinations to achieve the desired play environment. The inflatable play structures can be used individually and independently, with each other, and/or with or without connectors.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

The invention claimed is:

1. An inflatable play structure system, the system comprising:

an inflatable play structure comprising:

an inflatable envelope;

a weighted base attached to the inflatable envelope, the weighted base having a first base portion and a second base portion, the first base portion being attached to the second base portion by a base hinge, the weighted base further having a base edge; and a base fastener portion attached along the base edge;

wherein the first base portion and the second base portion are operable to enfold the inflatable envelope when the inflatable envelope is deflated and the first base portion and the second base portion are folded along the base hinge toward the inflatable envelope; and a connector comprising:

a panel having a first panel edge and a second panel edge;

a first panel fastener portion attached along the first panel edge; and a second panel fastener portion attached along the second panel edge;

wherein at least one of the first panel fastener portion and the second panel fastener portion is mateable with the base fastener portion.

2. The system of claim 1 wherein the base fastener portion is one of a hook fastener and a loop fastener, and the first panel fastener portion is the other of the hook fastener and the loop fastener.

3. The system of claim 1 wherein the base hinge is flexible material disposed between the first base portion and the second base portion.

4. The system of claim 1 wherein the first base portion comprises a first weight piece disposed between a first sheet and a second sheet, the second base portion comprises a second weight piece being disposed between the first sheet and the second sheet without the first weight piece and the second weight piece overlapping, and the first sheet and the second sheet are attached around the perimeter of the first weight piece and the second weight piece.

5. The system of claim 1 wherein the panel has a first panel portion and a second panel portion, the first panel portion being attached to the second panel portion by a panel hinge.

6. The system of claim 5 wherein the panel hinge is flexible material disposed between the first base portion and the second base portion.

7. The system of claim 5 wherein the first panel portion comprises a first weight piece disposed between a first sheet and a second sheet, the second panel portion comprises a second weight piece disposed between the first sheet and the second sheet without the first weight piece and the second weight piece overlapping, and the first sheet and the second sheet are attached around the perimeter of the first weight piece and the second weight piece.

8. The system of claim 1 further comprising a grommet defining a tie-down hole through at least one of the first panel edge and the second panel edge.

9. The system of claim 1 wherein the inflatable envelope defines a geometric figure when the inflatable envelope is inflated.

10. The system of claim 9 wherein the geometric figure is selected from the group consisting of a rectangular solid, a half-cylindrical solid, and a trapezoidal solid.

11. The system of claim 9 wherein the inflatable envelope further defines a tunnel through the geometric figure.

* * * * *